US006903624B2

(12) United States Patent
Stenberg et al.

(10) Patent No.: US 6,903,624 B2
(45) Date of Patent: Jun. 7, 2005

(54) APPARATUS AND METHOD FOR SHORTING WAVEGUIDE USING A PIVOTABLE VANE STRUCTURE

(75) Inventors: James Stenberg, Portland, ME (US); Richard Bibber, Gray, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/319,586

(22) Filed: Dec. 16, 2002

(65) Prior Publication Data

US 2004/0113726 A1 Jun. 17, 2004

(51) Int. Cl.[7] ..... H01P 1/10
(52) U.S. Cl. ..... 333/108; 333/248; 333/258
(58) Field of Search ..... 333/108, 248, 333/258

(56) References Cited

U.S. PATENT DOCUMENTS 2,647,951 A * 8/1953 Zaleski ..... 333/108
3,009,117 A * 11/1961 Lanctot ..... 333/108
3,390,355 A * 6/1968 Vliestra ..... 333/108
3,697,894 A * 10/1972 Johnson ..... 333/108

* cited by examiner

*Primary Examiner*—Benny Lee
(74) *Attorney, Agent, or Firm*—Baker & Hostetler LLP

(57) ABSTRACT

A center-pivoted, conductive vane equipped with contact-enhancing finger stock on the wiping edges rests during normal operation of a modified waveguide section parallel to and equidistant between the broad faces of the waveguide, where it interacts minimally with RF propagating through the waveguide. When it is desired to provide a short circuit to the waveguide, for a safety lockout or other uses, the vane can be rotated into a position to provide a substantial barrier to RF propagation. Rotating the pivot shaft, to which the vane is rigidly attached, performs rotation of the vane. The shaft is equipped with lockable stops for the open and shorted positions. Multiple center-pivoted vanes in a multiple-branch waveguide can form a switch.

18 Claims, 4 Drawing Sheets

APPARATUS AND METHOD FOR SHORTING WAVEGUIDE USING A PIVOTABLE VANE STRUCTURE

FIELD OF THE INVENTION

The present invention relates generally to high-power radio frequency transmission line components. More particularly, the present invention relates to an apparatus and method for inserting and/or removing a short circuit into a waveguide signal path.

BACKGROUND OF THE INVENTION

High power radio frequency (RF) transmission signals can have sufficient energy to make it desirable to provide safety equipment to reduce personnel exposure risk to the RF signals. Safety equipment to protect against excessive exposure to RF signals exists in many forms, including the use of switches and mechanical locks to keep transmitting equipment deenergized until the technician who applied the locks removes them, as well as many types of guards and other shields to protect a technician who may be near a radiation-capable mode when RF energy is inadvertently present.

High power RF signals are normally carried from a transmitter to a radiating antenna using either a relatively large-diameter—e.g., 1 inch to 1 foot—rigid coaxial line for frequencies below ultra-high frequency (UHF), or a waveguide for UHF and above. Waveguides, commonly rectangular or circular in cross section, are critically dimensioned with respect to frequency; specifically, a waveguide must be of at least a certain minimum size to carry RF signals of a certain frequency. The lower the frequency, the larger the waveguide must be; below the UHF television transmission band, waveguides can become too large (e.g., heavy, creating excessive wind drag in a feedline that extends up a transmission tower, and disproportionately expensive to manufacture) to be practical for many purposes. In the UHF band, however, waveguides are quite practical, even for signals of more than a megawatt.

Waveguides in general can provide distinct advantages when compared to a coaxial line. A coaxial line is limited in the power it can carry, because current flows in the conductors making up the line. Heating associated with that current flow becomes unacceptably large as power increases, requiring a larger coaxial line. Moreover, as frequency increases, depth of penetration of the current in the conductors decreases due to skin effect, so the increasing current flows in a decreasing volume of conductor, again dictating an increase in size. In addition to weight and wind load issues, very large coaxial lines also permit waveguide propagation modes; with different propagation rates, these cause severe distortion as well as damaging reflections.

Waveguides, as the name implies, provide primarily an environment in which the RF signal propagates. While there are losses (that is, conversion of RF signals to heat) associated with use of waveguides, the limit to the power level that can be carried is defined in terms of voltage peaks that cause arcing across the narrow dimension of the waveguide. For cases where equivalent weights and wind loadings exist, waveguides can carry significantly greater power than comparable coaxial lines. Moreover, as frequency increases, the measured loss in a given size of waveguide decreases. Thus, while the power level determines the size of a coaxial line the frequency of the signal determines the size of a waveguide.

Rectangular waveguides are normally operated in the fundamental mode for RF signal stability. This means that no signal with a frequency below cutoff, and thus a wavelength longer than the broad dimension of the waveguide, can propagate in a waveguide of a particular size. The Electronics Industry Association (EIA) specifies that for normal use, a waveguide should be half the size on the narrow axis that it is on the broad axis, which reasonably guarantees that the waveguide cannot spontaneously switch to the orthogonal propagation mode. Circular waveguides, which can more readily switch modes, require more care in application, but are still usable with switches and safety devices using the inventive apparatus.

Radiated UHF signals tend to be available for reception over a shorter distance from a transmitting antenna than signals at lower frequencies, such as very high frequency (VHF), which, in the U.S., includes the low-numbered television channels, 2 through 13, and the FM radio broadcast band. This is because UHF energy is attenuated more readily in the atmosphere and propagates strictly by line of sight. As a consequence, UHF broadcasters seeking to provide comparable reception quality over a comparable area are obliged to use higher power levels than VHF broadcasters, which increases the energy level in the system while it is energized. Representative power levels are 30 kilowatts (KW) for VHF and 200 KW for UHF. Such high energy levels represent intrinsic hazards for which good safety equipment is desirable.

Accordingly, there is a need in the art for a mechanical switch that can cause impinging RF signals in a waveguide to be at least substantially blocked from emission. It would also be desirable if such a switch could be further applied to provide a low-loss switch for directing RF signal flow in a high-power waveguide environment.

SUMMARY OF THE INVENTION

The invention in some embodiments provides a mechanical switch that can cause impinging RF signals in a waveguide to be at least substantially blocked from emission, and which can be further applied to provide a low-loss switch for directing RF signal flow in a high-power waveguide environment.

In one aspect, the invention provides an apparatus for applying a short circuit in a waveguide transmission line having a section of rectangular waveguide that permits propagation of RF energy in a propagation direction. The waveguide section has a first broad wall and an opposed second broad wall, a first narrow wall and an opposed second narrow wall, an inlet port through which RF energy is fed into the waveguide section, and an outlet port through which RF energy exits the waveguide section. A vane is pivotable between a first, shorting position, at which position the vane substantially blocks propagation of RF energy, and a second, open position, at which position the vane substantially passes RF energy.

In another aspect, a multiple port switching system features a waveguide path structure having at least three ports including at least one inlet port and at least one outlet port; and a vane disposed within at least one of the ports, where the vane is movable between a first, shorting position, at which the vane substantially blocks propagation of RF energy, and a second, open position, at which the vane substantially passes RF energy.

In another aspect, the invention provides an apparatus for applying a short circuit in a waveguide transmission line having means for substantially blocking propagation of RF energy in a waveguide when the blocking means is in a first, blocking position, and means for moving the blocking means between the first position and a second position, substantially perpendicular to the first position, at which second position the blocking means substantially passes RF energy.

In another aspect, a method for applying a short circuit in a waveguide transmission line is accomplished by rotating within the waveguide a barrier device that establishes a short circuit along the propagation path when so rotated as to cause two opposite edges of the barrier device to contact opposite sides of the waveguide, and removes the short circuit when the barrier device is so rotated as to lie in the propagation plane of the waveguide, substantially equidistant between the opposite sides that were shorted together in the short circuit configuration.

There have thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. It is also to be understood that the phraseology and terminology employed herein, as well as the abstract, are for the purpose of description, and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

The invention in some embodiments provides a mechanical switch that can cause impinging RF signals in a waveguide to be at least substantially completely blocked from emission, and which can be further applied to provide a low-loss switch for directing RF signal flow in a high-power waveguide environment.

Figure 1:
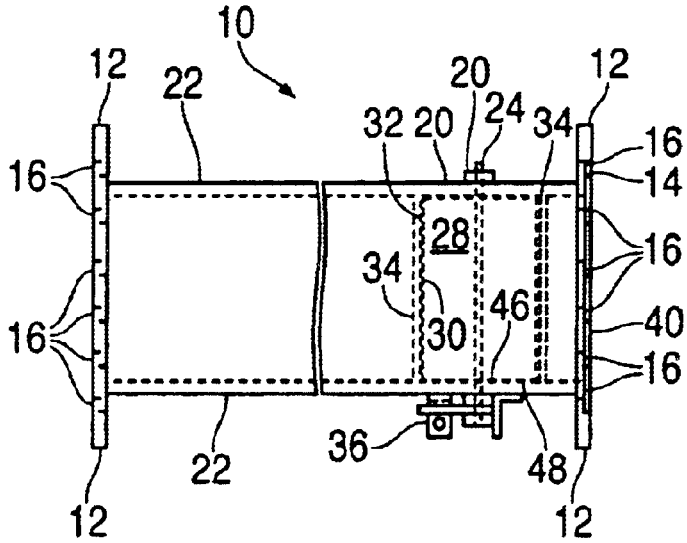
FIG. 1 is a top layout view illustrating a section of rectangular waveguide with a vane according to a preferred embodiment of the present invention.
Figure 2:
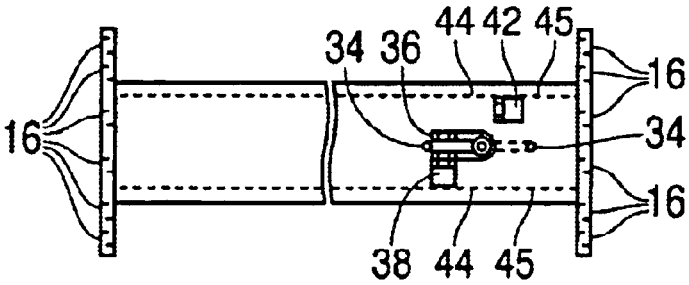
FIG. 2 is a side layout view of the apparatus of FIG. 1.
Figure 3:
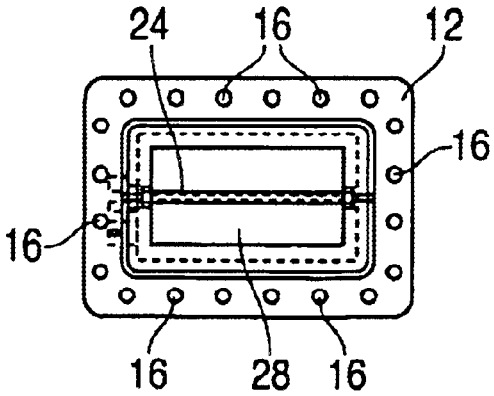
FIG. 3 is an end layout view of the apparatus of FIG. 1.
Figure 4:
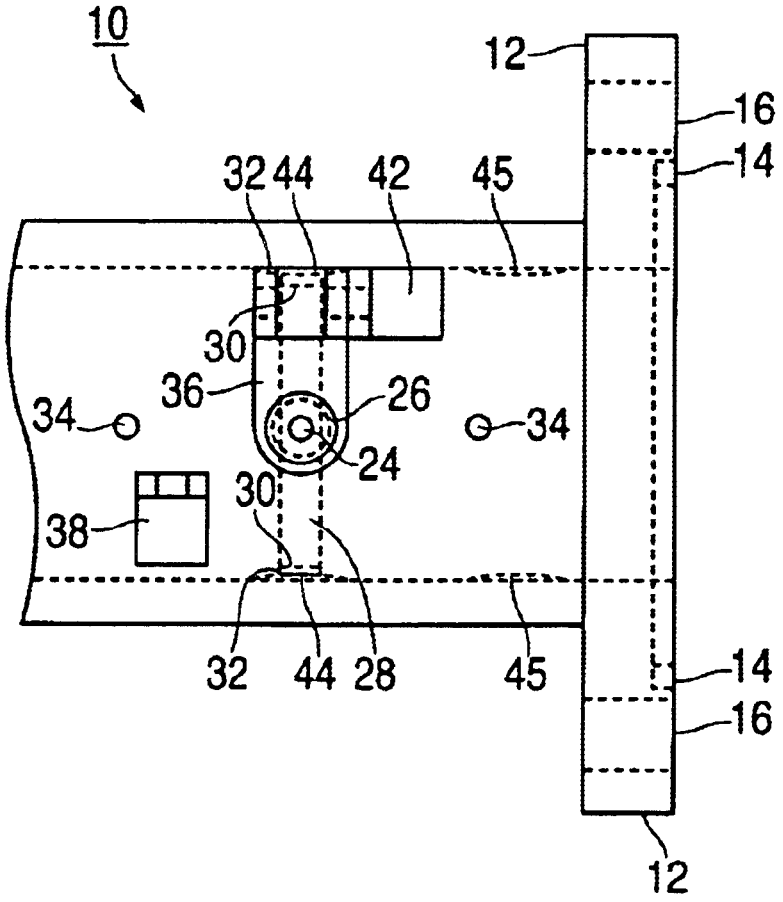
FIG. 4 is a side layout detail view of a rectangular waveguide according to a preferred embodiment of the invention.

As shown in the sectional views in FIG. 1 through FIG. 4, a preferred embodiment of the invention has a rectangular waveguide section 10 with mounting flanges 12 on both ends (shown in FIGS. 1 and 4). FIGS. 1 and 4 illustrate one flange which has an O-ring groove 14, so that the preferred embodiment may be assembled in line with regular waveguide sections, each of which typically features a single O-ring at each joint. FIGS. 1 and 2 illustrate mounting holes 16 which are sufficient in number to provide uniform tension around the perimeter of each joint; to provide mechanical rigidity; to stabilize section-to-section alignment, keeping voltage standing wave ratio (VSWR) low; and to keep the broad dimension of each slot formed by the flanges and bolts below cutoff, substantially preventing RF leakage even in event of loss of metal-to-metal contact.

FIG. 1 illustrates cross holes 20 which are located in the center of the narrow sidewalls 22, i.e., the waveguide surfaces in which the current flowing is reactive only and contains none of the propagating power. Placement of the holes at the center of the narrow walls minimizes discontinuity to the propagating signal by the cross holes. A pivot shaft 24 rests in the cross holes 20. Since a high-power waveguide system should typically be treated in such a way as to keep it free of corrosion despite a potentially harsh environment, some implementations may force filtered, dried, and preferably deoxygenated air or high-purity nitrogen into the system. In these implementations it is preferable to include shaft O-rings 26 to reduce leakage and thus minimize the need for makeup gas. However, some systems may have some or all upressurized sections.

A conductive plate, termed here a vane 28, rests in the orientation shown in FIGS. 1, 3 and 4 during normal operation of the waveguide section 10. In this orientation, the effect of the vane 28 on the RF behavior of the waveguide section 10 is slight, allowing normal operation at full power with negligible degradation compared to a plain waveguide section of equivalent configuration.

As shown in FIG. 1 and FIG. 4, the two vane edges 30 parallel to the pivot shaft ends have bonded to them conductive contact fingers 32, which preferably feature a multiplicity of individually articulated elements cut partially free from a ribbon of spring material and formed to the desired shape. The commercial product known to those knowledgeable in the art as "finger stock," which product is available in various materials and finishes, may preferably be used for this application.

When the vane 28 is in the position shown in FIG. 1 and FIG. 3 (referred to here as the "normal operation" or "open" position or orientation), the contact fingers 32 rest against landing rods 34 that provide increased stability and reduce the exposure of the contact fingers 32 to RF.

As shown in FIGS. 1, 2 and 4, a lever 36 rests against a normal-operation stop 38 (shown in FIGS. 2 and 4) during normal system operation. The lever 36 can serve as a visible indicator of the position of the vane 28 (shown in FIGS. 1, 3 and 4). The stop 38 may be provided with a locking device, have an added spring detent or latch to immobilize the vane 28 against vibration, or may otherwise prevent the vane 28 from moving inadvertently partly or fully into a closed position.

When a user wishes to prevent RF energy from exiting the waveguide at an exit port 40 (shown in FIG. 1), the user rotates the level 36 to the opposite extreme of travel against a blocking stop 42, so that the vane 28 is positioned as shown in FIG. 2 and FIG. 4 (referred to here as the "closed," "blocking" or "shorting" position or orientation). The blocking stop 42 may, like the normal-operation stop 38, incorporate additional lockout and tagout features that prevent the vane 28 from moving inadvertently partly or fully into the opposite orientation.

When the vane 28 is positioned to block RF energy emission, the fingers 32 rest on contact regions 44 (shown in FIGS. 2 and 4) on the surface of the broad faces of the waveguide. These contact regions 44 can be somewhat raised from the rest of the waveguide surfaces, for example by deposition of extra metallic silver, to provide additional thickness of conductive material to allow for wear. Such raised surface regions in waveguide—in this case symmetrically positioned on the broad facing walls—are capacitive, and can if large enough produce a measurable reflection back into the source. Performance of the system can be substantially restored in that event by positioning a set of geometrically similar lumps 45 (shown in FIGS. 2 and 4) about one-quarter wavelength along the waveguide between that vane and the port it shutters in order to introduce a compensating feature that can reduce or prevent signal reflection.

As shown in FIG. 1, the vane edges 46 perpendicular to the pivot shaft and parallel to the waveguide narrow sidewalls may or may not have contact fingers and may or may not be isolated from the adjacent walls 48 in order to avoid arcing. However, if the vane is not in contact with the sidewalls, the isolation interval between vane edges and the walls should generally be selected to avoid an excessive gap that could result in detectable RF leakage past the vane.

Figure 5:
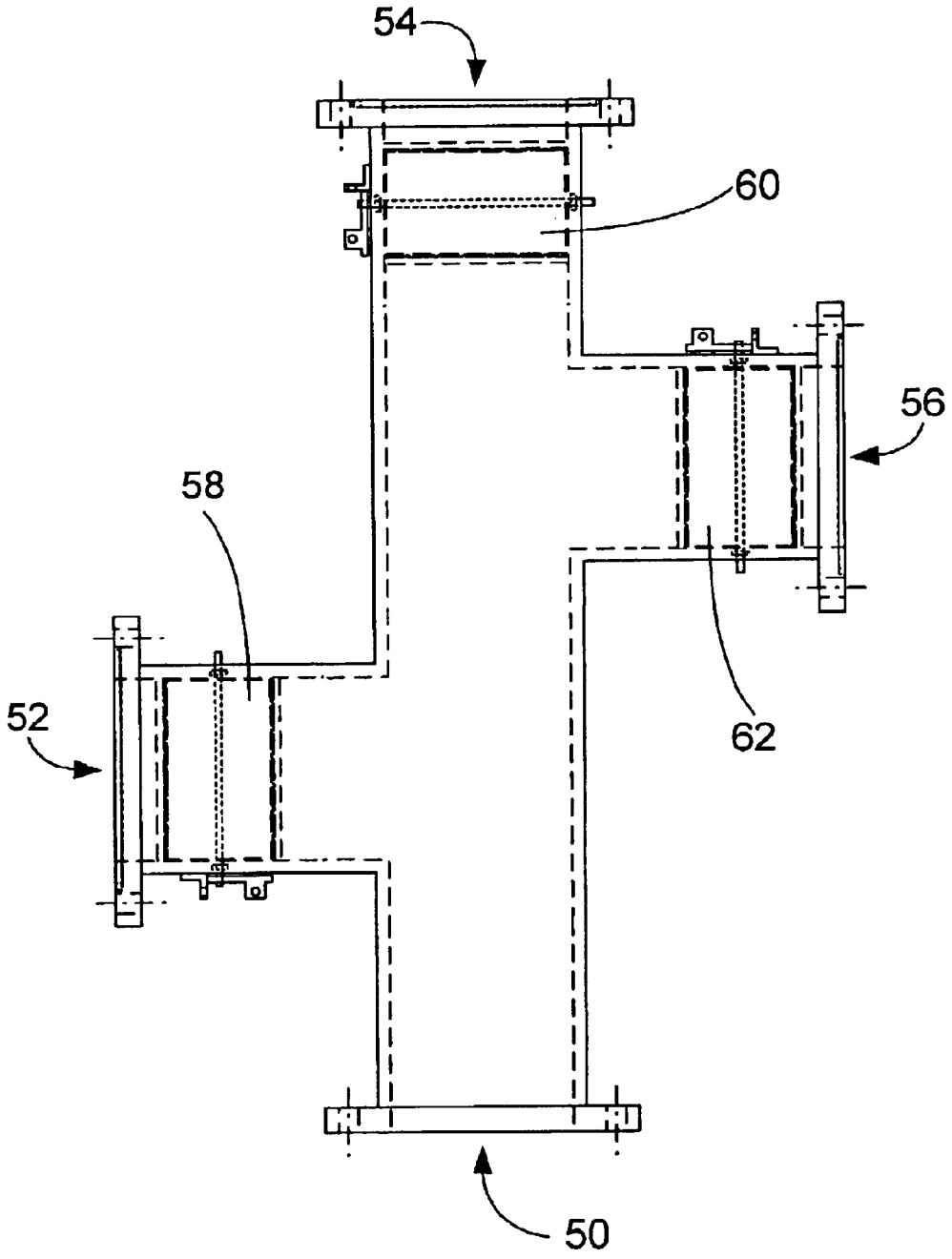
FIG. 5 is a top view of an alternative embodiment using the waveguide shorting mechanism as a switch from one to another signal path in a fixed installation.

The inventive apparatus can be used for operational waveguide switching as well as for provision of safety lockouts. FIG. 5 is a top view of an alternate embodiment of the inventive apparatus. Here, the waveguide and vanes are used as a switch within a system that remains fully assembled while the RF signal(s) is steered to one of two or more loads, or one of two or more sources is steered to one load. This embodiment is suitable for example where it is desired to have a dummy load permanently installed for rapid system checks, or where two different antennas or transmitters are used.

FIG. 5 illustrates four ports, of which one is a non-switchable port 50 and the other three are first, second, and third switchable ports 52, 54, and 56. The first, second, and third vanes 58, 60, and 62 shown in this view each establish a short circuit between the broad walls when closed. Laterally opposed ports 52 and 56 should preferably be offset in order to minimize interaction. Each closed vane 58 and 62, set approximately one-half wavelength from the intersection between the main waveguide and the port it blocks, causes its port to appear as a good approximation of a continuation of the wall if so placed. The end vane 60, located a multiple of one-half wavelength from the centers of the side branches, similarly simulates a properly positioned wall.

Figure 6:
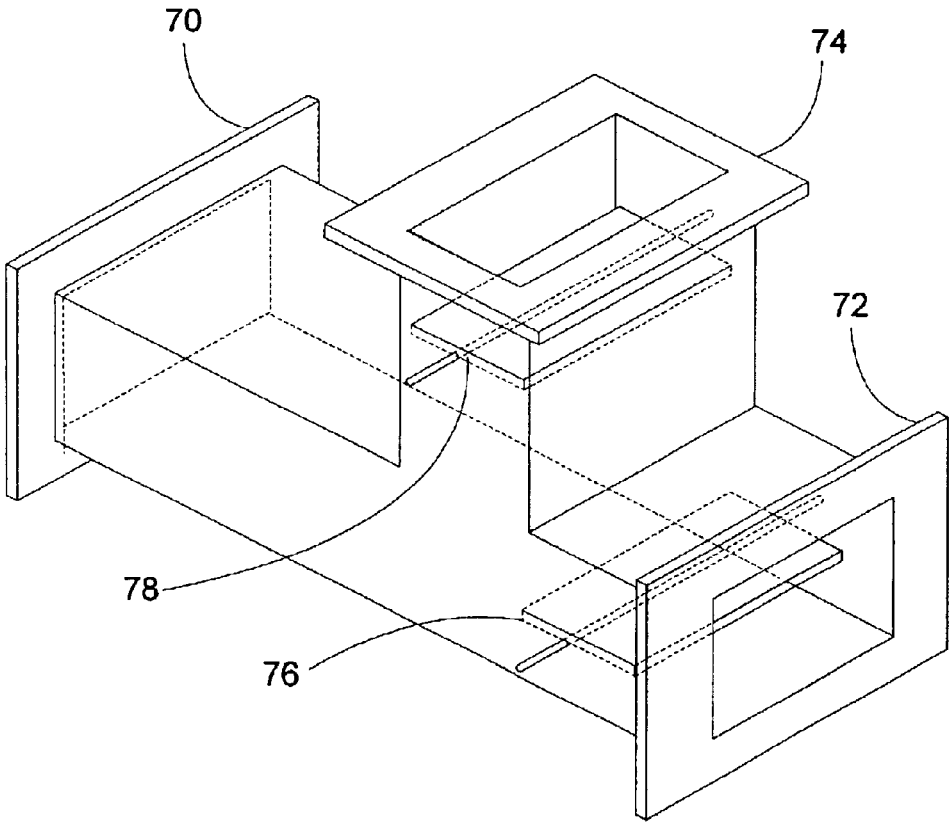
FIG. 6 is an oblique view of a second alternative embodiment.

When this embodiment is used to implement a switch between two or more inputs or outputs, the vanes, such as 58, 60, and 62 in FIG. 5, can establish short circuit planes. Such shorting planes, if located at some multiple of one-half wavelength from a location appropriate for a wall in an ordinary section of waveguide, will produce the same electrical behavior as such a wall. It is preferred that a particular switch be sized for this function to avoid a mismatch that could increase VSWR and degrade system performance. The orientation of the alternate ports can be either all in the horizontal plane when the broad axis is the axis of the fundamental, as shown in FIG. 5—or all in the vertical plane, as shown in the 3-port section in FIG. 6. FIG. 6 shows a non-switchable port 70 and switchable ports 72 and 74, with vanes 76 and 78 to close the respective ports.

When the vanes 28 (and 58–62, 76, and 78) are in the closed position, they provide effective blocking. When fully open, the vanes 28 (and 58–62, 76, and 78) are substantially invisible to the high-power signals present in the intended applications. When positioned obliquely, vanes 28 (and 58–62, 76, and 78) provide significant reflections, so it is preferred that they not be allowed to sit in positions other than at the stops 38 and 42 when RF power is present in the waveguides.

Returning to FIGS. 1 through 4, the preferred embodiment of a waveguide shorting mechanism as illustrated in FIGS. 1 through 4 presents a vane 28 design that can be constructed from a variety of materials. Preferably, a vane 28 to be used in this application can be made from a plate of solid copper, drilled to pass the pivot shaft 24. The pivot shaft 24 can also be of larger diameter, featuring either a slot through which the vane 28 passes or a flat onto which the vane 28 is attached by a suitable fastening method. The surface of the vane 28 can be finished in silver, which affords maximum skin conductivity. Attachment of the material making up the contact fingers 32 to the vane edges 30 is preferably performed by soldering or another method suitable to the materials and stresses.

Typical waveguide sections 10 are preferably fabricated from aluminum or another material combining low weight, high strength, high conductivity, and the ability to accept durable finishes, while vanes 28 and other mechanically unstressed components for such applications are preferably made from materials such as copper that combine exceptional conductivity with acceptable mechanical strength. Pivot shafts 24, landing rods 34, levers 36, and other mechanically loaded components are preferably resistant to structural stresses, weather, pollution, and other hazards, all of which suggest the use of materials such as, for example, beryllium copper, phosphor bronze, stainless steel, and the like. Nonconductors with desirable mechanical properties, such as fiber filled polymers and the like, if they satisfy electrical and environmental requirements as well as mechanical, may be chosen for those purposes for which they are suited. It is preferable in an assembly composed of a variety of metals and alloys to select those materials to have either similar electronegativities (where "similar" is typically defined as a difference of 0.25 or less on the unitless Pauling scale) and/or very high resistance to corrosion. Dimensional stability with temperature, such as is exhibited by the alloy inconel, is also desirable, although alternative methods for compensating for dimensional changes are well established in the art.

For applications where remote operation may be required, activation motors, position sensors, end-of-travel switches, and interlock mechanisms can be employed. For example, such mechanisms may be used so that a transmitter do-not-energize condition is indicated whenever any vanes are not in either full-closed or full-open position. Control signals from end-of-travel switches can be made available to a controller to allow interlocking of power sources and switches. When using the invention in an RF power switching configuration, activation motors, position sensors, and interlocks can be so used as to ensure that only one vane is oriented to pass energy at a time, that no vane motion is permitted when RF is being generated, and that manual overrides at the switch can cause the transmitter to shut down automatically.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described; accordingly, all suitable modifications and equivalents may be resorted to that fall within the scope of the invention.

What is claimed is:

1. An apparatus for applying a short circuit in a waveguide transmission line, comprising:

a section of rectangular waveguide that permits propagation of radio frequency (RF) energy, said section having a first broad wall, an opposed second broad wall, a first narrow wall, and an opposed second narrow wall;

an inlet port through which said RF energy is fed into said waveguide section;

an outlet port through which said RF energy exits said waveguide section;

a vane positioned within the inlet port and pivotable between a shorting position at which said vane substantially blocks propagation of said RF energy into the inlet port and an open position at which said vane substantially passes said RF energy through the inlet port; and a pivot shaft penetrating said waveguide section and perpendicular to a direction of propagation of said RF energy, said pivot shaft centered across between the broad walls of said waveguide section, said pivot shaft affixed to said first and second narrow walls and serving as the pivoting member for said vane.

2. The apparatus of claim 1, further comprising a visible indicator that indicates the position of said vane.

3. The apparatus of claim 1, wherein said vane further comprises two contact enhancing edge features so configured as to contact both of said opposed broad walls when said vane is in the shorting position.

4. The apparatus of claim 3, wherein the wall surfaces met by said contact enhancing edge features comprise wear-reinforced regions of conductive material.

5. The apparatus of claim 4, wherein, on the wall surfaces, regions of conductive material are positioned approximately one-quarter wavelength from the wear-reinforced regions of conductive material.

6. The apparatus of claim 3, wherein said contact enhancing edge features comprise strips of conductive material.

7. The apparatus of claim 3 wherein said contacting edge features comprise strips of spring finger conductive material.

8. The apparatus of claim 1, further comprising two landing rods that contact said vane edge features when said vane is oriented in the open position.

9. The apparatus of claim 1, further comprising a seal that seals the connection of said pivot shaft and said rectangular waveguide section.

10. The apparatus of claim 1, further comprising a level attached to the pivot shaft to facilitate rotation of the pivot shaft.

11. The apparatus of claim 1, further comprising a first travel stop that stops the vane in the shorting position.

12. The apparatus of claim 1, further comprising:

a first travel stop that stops the vane in the shorting position; and a second travel stop that stops the vane in the open position.

13. The apparatus of claim 1, further comprising a first lock that locks the vane in the shorting position.

14. The apparatus of claim 1, further comprising:

a first lock to lock the vane in the shorting position; and a second lock to lock the vane in the open position.

15. A multiple port switching system, comprising:

a waveguide path structure having at least three ports including at least one inlet port and at least one outlet port; and a respective pivot shaft mounted vane disposed within each of at least two of said ports, each vane being movable between a shorting position at which each said vane substantially blocks propagation of RF energy, and an open position at which each said vane substantially passes RF energy, wherein the shorting position and the open position are substantially perpendicular to each other, and wherein the open position is within a mid-plane of said respective port of said waveguide path structure.

16. An apparatus for applying a short circuit in a waveguide transmission line, comprising:

means for substantially blocking propagation of RF energy within a port of a waveguide when said blocking means is in a blocking position; and means for moving said blocking means between the blocking position and a passing position substantially perpendicular to the blocking position, at which said blocking means substantially passes RF energy and, wherein the passing position places the blocking means substantially within a mid-plane of the port of the waveguide.

17. The apparatus of claim 16, further comprising means for selectively securing said blocking means in at least one of said positions.

18. The apparatus of claim 16, further comprising means for indicating the position in which said blocking means is oriented.

* * * * *